US010315905B2

(12) United States Patent
Humele et al.

(10) Patent No.: US 10,315,905 B2
(45) Date of Patent: Jun. 11, 2019

(54) APPARATUS AND METHOD FOR FILLING, CLOSING AND LABELLING CONTAINERS

(71) Applicant: KRONES AG, Neutraubling (DE)

(72) Inventors: Heinz Humele, Thalmassing (DE); Horst Winter, Neutraubling (DE)

(73) Assignee: KRONES AG, Neutraubling (DE)

( * ) Notice: Subject to any disclaimer, the term of this patent is extended or adjusted under 35 U.S.C. 154(b) by 1126 days.

(21) Appl. No.: 14/368,877

(22) PCT Filed: Dec. 19, 2012

(86) PCT No.: PCT/EP2012/076190

§ 371 (c)(1),
(2) Date: Oct. 14, 2014

(87) PCT Pub. No.: WO2013/098162

PCT Pub. Date: Jul. 4, 2013

(65) Prior Publication Data

US 2015/0143778 A1 May 28, 2015

(30) Foreign Application Priority Data

Dec. 29, 2011 (DE) ..... 10 2011 057 112

(51) Int. Cl.
*B65B 7/28* (2006.01)
*B65B 61/00* (2006.01)
(Continued)

(52) U.S. Cl.
CPC ..... *B67C 7/004* (2013.01); *B65C 3/14* (2013.01); *B65C 9/02* (2013.01); *B67C 7/00* (2013.01); *B67C 7/0013* (2013.01)

(58) Field of Classification Search
CPC ..... F17C 13/00; A61G 10/005; B65B 7/28; B65B 61/00; B65B 57/02; B65D 90/22;
(Continued)

(56) References Cited

U.S. PATENT DOCUMENTS 2,731,778 A * 1/1956 Loufek ..... B31B 50/00 229/123.2
3,653,176 A 4/1972 Gess

FOREIGN PATENT DOCUMENTS

DE 2539857 3/1977
DE 3927489 2/1991
(Continued)

OTHER PUBLICATIONS

International Search Report dated Mar. 27, 2013 in corresponding PCT Application No. PCT/EP2012/076190.

*Primary Examiner* — Andrew M Tecco
*Assistant Examiner* — Mary C Hibbert
(74) *Attorney, Agent, or Firm* — Onello & Mello, LLP

(57) ABSTRACT

An apparatus for processing containers comprises a movable carrier for conveying the containers. A plurality of filling units is in communication with the movable carrier. The filling units are constructed and arranged to fill the containers with a flowable medium during the conveying of the containers. A plurality of labelling devices is in communication with the movable carrier. The labelling devices are constructed and arranged to apply labels to the containers during the conveying of the containers. A plurality of closing units is in communication with the movable carrier. The closing units constructed and arranged to close the containers filled with the flowable medium during the conveying of the containers.

12 Claims, 4 Drawing Sheets

(51) Int. Cl.

| | |
|---|---|
| ***B65B 57/02*** | (2006.01) |
| ***B67C 7/00*** | (2006.01) |
| ***B65C 3/14*** | (2006.01) |
| ***B65C 9/02*** | (2006.01) |

(58) Field of Classification Search

CPC ..... B67C 3/06; B67C 3/242; B67C 3/225; B67C 3/26; B67C 3/007; B67C 3/004; B67C 3/0013; B65C 3/14; B65C 9/02

USPC ..... 53/415, 471, 282, 136.1, 436, 526; 198/464.4, 719; 156/280, 390

See application file for complete search history.

(56) References Cited

FOREIGN PATENT DOCUMENTS

| | | | | |
|---|---|---|---|---|
| DE | 3927489 | A1 * | 2/1991 | ..... B65C 3/26 |
| FR | 2151725 | | 4/1973 | |
| FR | 2576003 | | 7/1986 | |
| FR | 2576003 | A1 * | 7/1986 | ..... B65G 29/00 |
| FR | 2616766 | | 12/1988 | |
| GB | 245071 | | 5/1926 | |
| GB | 473826 | | 10/1937 | |
| WO | WO2009040325 | | 4/2009 | |

* cited by examiner

APPARATUS AND METHOD FOR FILLING, CLOSING AND LABELLING CONTAINERS

RELATED APPLICATIONS

This application is a 371 national phase entry application of International Application Number PCT/EP2012/076190, filed on Dec. 19, 2012, which claims the benefit of German patent application number 10 2011 057 112.4, filed on Dec. 29, 2011, the contents of which applications are incorporated herein in their entirety by reference.

BACKGROUND

1. Field

The present inventive concepts relate to an apparatus and a method for the filling, closing, and labelling of containers.

2. Description of Related Art

It is well-known to those of ordinary skill in the art that, in the beverage-producing industry, containers, for example plastics material containers, are filled with a fluid, sealed or otherwise closed, and labelled. Here, it is typical for a plurality of filling units adjoining one another to be provided, for example, for filling the containers, a closing apparatus arranged downstream of the filling units for closing the containers with closures, and a labelling unit which applies labels to the outer wall of the containers.

In addition, an apparatus can be provided in which a labelling of the containers is carried out only after the containers are filled, as well as apparatus in which the filled, but still not closed, containers are labelled.

SUMMARY

In one aspect, provided is an apparatus for processing containers, comprising a movable carrier for conveying the containers; a plurality of filling units coupled to the movable carrier, the filling units constructed and arranged to fill the containers with a flowable medium during the conveying of the containers; a plurality of labelling devices coupled to the movable carrier, the labelling devices constructed and arranged to apply labels to the containers during the conveying of the containers; and a plurality of closing units coupled to the movable carrier, the closing units constructed and arranged to close the containers filled with the flowable medium during the conveying of the containers.

In some embodiments, the carrier is rotatable about a pre-set axis of rotation.

In some embodiments, the filling units, the labelling devices, and the closing units communicate with the carrier in such a way that each container is conveyed at least twice by the carrier in order to be filled, labelled and closed.

In some embodiments, the filling units and the closing units are arranged offset from one another on the carrier.

In some embodiments, the labelling units are stationary with respect to the movable carrier.

In some embodiments, the labelling units are interchangeable.

In some embodiments, containers treated in different ways are supplied to the carrier.

In some embodiments, the apparatus further comprises a supply device that supplies the containers to the carrier.

In some embodiments, the apparatus further comprises a first supply unit and a second supply unit that supply containers to the supply device.

In some embodiments, the apparatus further comprises at least one distribution changing device which changes a distribution between the containers.

In some embodiments, the filling units comprise filling elements which are constructed and arranged on the carrier and which move jointly with the containers at least sectionwise.

In some embodiments, the closing units comprise closure elements which are constructed and arranged on the carrier, and which move jointly with the containers at least sectionwise.

In some embodiments, each filling unit, the labelling device, and closing unit is coupled to the movable carrier.

In some embodiments, at least one of the filling units, the labelling devices, and the closing units is separate from and in communication with the movable carrier and the remainder of the filling units, the labelling devices, and the closing units is coupled to the movable device.

In one aspect, provided is a method of treating containers, comprising conveying, by a movable carrier, the containers; filling, by treatment units the containers with a flowable medium during the conveying of the containers; labelling, by the treatment units, the containers during the conveying of the containers; and closing, by the treatment units, the containers filled with the flowable medium during the conveying of the containers.

In some embodiments, the containers are conveyed during the treatment by the treatment units at least twice in each case by means of the carrier.

In some embodiments, a distribution between the containers is changed at least once during the treatment thereof.

In some embodiments, each filling unit, labelling device, and closing unit is coupled to the movable carrier.

In some embodiments, at least one of the filling units, the labelling devices, and the closing units is separate from and in communication with the movable carrier and the remainder of the filling units, the labelling devices, and the closing units is coupled to the movable device.

In some embodiments, the filling units comprise filling elements which are constructed and arranged on the carrier and which move jointly with the containers at least sectionwise, and the closing units comprise closure elements which are constructed and arranged on the carrier, and which move jointly with the containers at least sectionwise.

DESCRIPTION OF THE DRAWINGS

The above and other aspects and features of the present inventive concepts will become more apparent by describing in detail exemplary embodiments thereof with reference to the attached drawings, in which.

DETAILED DESCRIPTION

Figure 1:
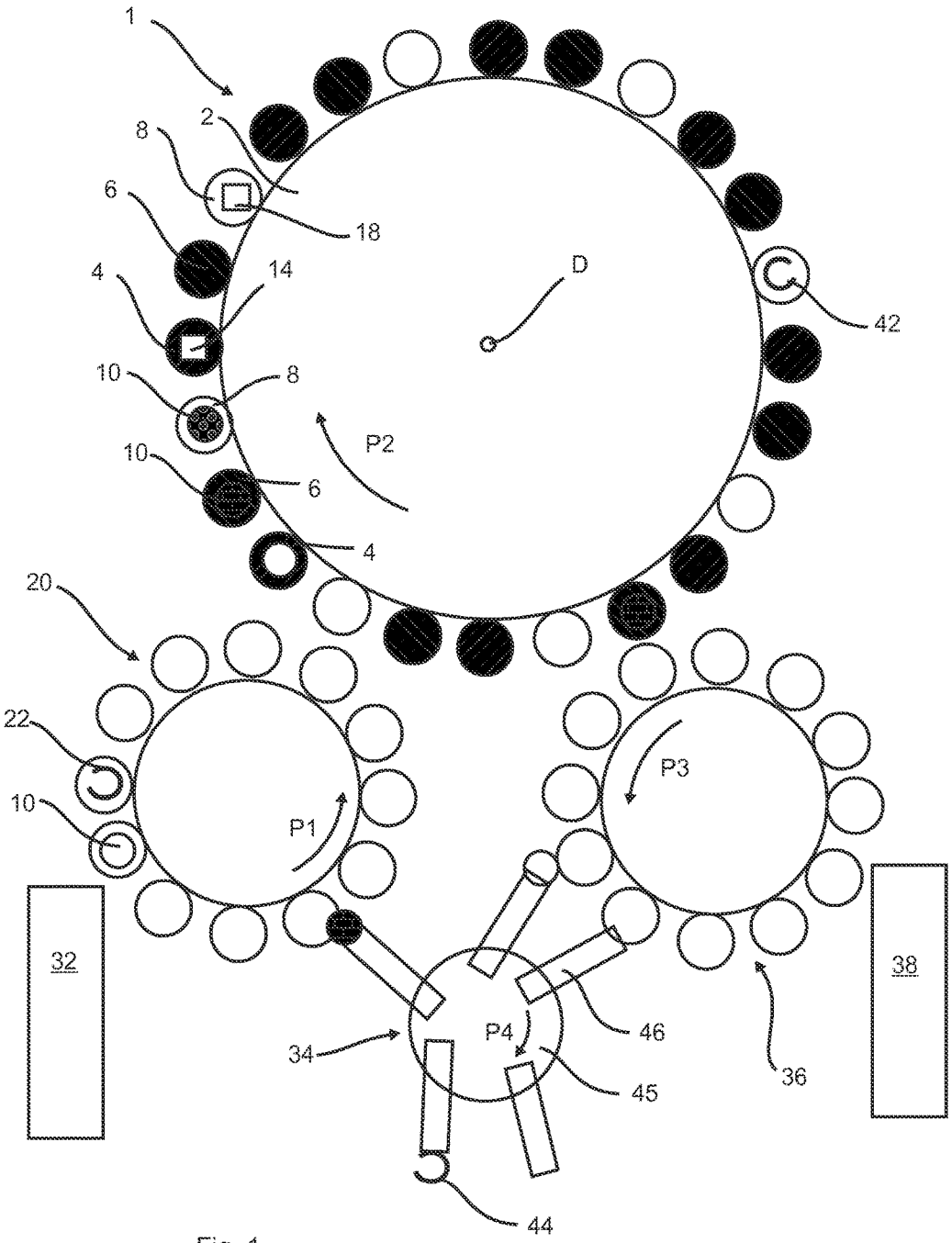
FIG. 1 is an illustration of an apparatus in accordance with an embodiment of the inventive concepts.

Exemplary embodiments in accordance with principles of inventive concepts will now be described more fully with reference to the accompanying drawings, in which exemplary embodiments are shown. Exemplary embodiments in accordance with principles of inventive concepts may, however, be embodied in many different forms and should not be construed as being limited to the embodiments set forth herein; rather, these embodiments are provided so that this disclosure will be thorough and complete, and will fully convey the concept of exemplary embodiments to those of ordinary skill in the art. Like reference numerals in the drawings denote like elements, and thus their description may not be repeated.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Like numbers indicate like elements throughout. As used herein the term "and/or" includes any and all combinations of one or more of the associated listed items. Other words used to describe the relationship between elements or layers should be interpreted in a like fashion (e.g., "between" versus "directly between," "adjacent" versus "directly adjacent," "on" versus "directly on").

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of exemplary embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of exemplary embodiments. As used herein, the singular forms "a," "an" and "the" are intended to include the plural forms as well, unless the context clearly indicates otherwise. It will be further understood that the terms "comprises", "comprising", "includes" and/or "including," if used herein, specify the presence of stated features, integers, steps, operations, elements and/or components, but do not preclude the presence or addition of one or more other features, integers, steps, operations, elements, components and/or groups thereof.

Exemplary embodiments in accordance with principles of inventive concepts are described herein with reference to cross-sectional illustrations that are schematic illustrations of idealized embodiments (and intermediate structures) of exemplary embodiments. As such, variations from the shapes of the illustrations as a result, for example, of manufacturing techniques and/or tolerances, are to be expected. Thus, exemplary embodiments in accordance with principles of inventive concepts should not be construed as limited to the particular shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of exemplary embodiments.

Unless otherwise defined, all terms (including technical and scientific terms) used herein have the same meaning as commonly understood by one of ordinary skill in the art to which exemplary embodiments in accordance with principles of inventive concepts belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

Devices for filling containers are well-known, for example, German Patent Application No. DE 39 27 489 A1, incorporated by reference herein in its entirety. In this case, containers are filled during a conveying process, and are labelled by other container treatment devices, such as labelling devices, arranged along a container path. Alternatively, the containers are printed by way of separate printing devices.

Patent Application No. WO 2005/058734 A1 incorporated by reference herein in its entirety describes a method and an apparatus for the manipulation of receptacles, in which a path in the conveying direction of these receptacles between a run-in and a run-out station is designed in the form of a multiple passage path. In this manner, a plurality of testing procedures can be carried out, for example, on respective receptacles during the passage through the path.

Patent Application No. FR 2 576 003 incorporated by reference herein in its entirety describes a method and an apparatus for subjecting articles to a multiplicity of treatment steps of the same treatment unit.

A method and an apparatus for the production of a labelled plastic bottle is known from Patent Application DE 198 06 647 A1, incorporated by reference herein in its entirety. In this case, a blow moulding station provides for the shaping of plastics material pre-forms into plastics material containers. The blow moulding station is upstream of an apparatus for labelling plastics material pre-forms.

An object of the present inventive concepts is to make apparatus of this type more compact as compared with the prior art.

An apparatus according to the inventive concepts for the treatment of containers has a movable carrier for conveying the containers to be treated as well as a plurality of treatment units which treat each container in a pre-set manner. In this case, the treatment units of a first group of the treatment units include filling units which fill the containers with a flowable medium, preferably a liquid and, in particular, a beverage. The filling units have in each case filling elements, which are constructed and arranged on the carrier and which move jointly with the containers at least sectionwise. In addition, the treatment units of a second group of these treatment units include labelling devices which apply labels to the containers. The treatment units of a third group of these treatment units include closing units which close with a closure the containers filled with the flowable medium, and which have in each case closure elements which are arranged on a carrier and which move jointly with the containers at least sectionwise.

According to the inventive concepts, the treatment units are arranged with respect to the carrier in such a way that the filling of the containers by the first filling units, the labelling of the containers by the labelling units, and the closing of the containers by the closing units take place during a conveying of the containers by a single movable carrier. The carrier can serve as a conveying device for the conveying of the containers. Accordingly, a combined machine is provided, which both fills and closes the containers, and also provides them with labels. Labelling can take place before or after the filling or even after the closing or sealing of the containers. In contrast to conventional apparatuses, the containers in accordance with embodiments are filled, labelled and closed while being conveyed with a carrier.

In this manner, filling units can be arranged on the carrier in a fixed manner in each case and for the filling units also preferably to have conveying elements or gripping elements respectively which hold the containers while the containers are being filled. In a similar manner, closure units can also be arranged on the carrier in a fixed manner and can hold or guide the containers respectively while the latter are closed with a closure. In addition, the labelling units can be arranged at least in part on the carrier in a fixed manner. It would also be possible, however, for the labelling units to be arranged so as to be stationary for example about an external periphery of the carrier in order to label the containers.

The present inventive concepts further relate to an apparatus for the treatment of containers with a movable carrier. The carrier conveys the containers to be treated and have a plurality of treatment units which treat each container in a pre-set manner. A first group of the treatment units include filling units which fill the containers with a flowable medium. The filling units have in each case filling elements which are arranged on a carrier and which move jointly with the containers at least sectionwise. A second group of the treatment units include labelling devices which apply labels to the containers.

According to embodiments of the inventive concepts, the treatment units are arranged with respect to the carrier in such a way that the filling of the containers by the first filling units and the labelling of the containers by the labelling units are performed during a conveying of the containers by a movable carrier. In addition, the apparatus has a closing unit for closing the containers with closures. The apparatus has for closing purposes a plurality of closing units which close the containers filled with the flowable medium with a closure. The closing units are arranged in such a way that the containers filled by the filling units are first closed by the closing units, then labelled by the labelling devices.

The closing units are not necessarily present on the movable carrier, but can be separate therefrom, for example, positioned on a separate closing unit. It is advantageous for the empty containers first to pass through the apparatus mentioned above and to be filled during this pass. After that, the containers are transferred to the closing means by way of a conveying device, such as a conveying star wheel, and are provided with closures there. After that, the closed containers are transferred again to the apparatus and are provided with labels thereon.

It is therefore advantageous for at least one conveying device, which transfers the containers to the closing unit, to be provided between the movable carrier and the closing device. It is advantageous for a second conveying device or a second conveying unit respectively, which transfers the closed containers to the combined filling and labelling unit again, also to be provided.

It is advantageous for one of the two conveying devices, preferably for both of the conveying devices to be a distribution delay star wheel and/or a multiple-function star wheel.

In the case of a further advantageous embodiment the closing device has a carrier which is smaller with respect to diameter as compared with the filling device. This takes into consideration the fact that such a large diameter, such as for example in the case of a filling machine, is not necessary for the closing means.

In some embodiments, the containers are brought to a division at the filling device by an infeed worm or the like and transferred to a run-in star wheel. The containers are filled and are conveyed in the run-out star wheel and are then passed by the same star wheel to the closing device. After the containers have been closed, they are again brought into the division of the labelling machine by the run-in star wheel, for example, a distribution delay star wheel.

After the containers have been labelled, the run-out star wheel, which also serves to supply the containers to the closing device, passes the containers to a run-out.

The apparatus can be a machine which operates continuously, i.e., the containers are moved continuously during the treatment procedures. The machine can be in the form of a clock time machine which conveys the containers in a clock-timed manner.

In a further advantageous embodiment, the carrier is a carrier rotatable about a pre-set axis of rotation. In this way, the machine can be a rotary machine, in which case the filling units and/or the closing units are arranged on a corresponding rotatable carrier in the manner of a filling turntable or closing turntable respectively.

In a further advantageous embodiment, the treatment units are arranged on or with respect to the carrier in such a way that each container is conveyed at least twice by the carrier, in particular along a substantially equal conveying path, in order to be filled, labelled and closed. In this way, the containers can be filled and closed in a first revolution on or by the carrier and labelled in a second revolution.

The containers can be filled and labelled in a first revolution and closed in a second revolution. Finally, the containers can be filled in a first revolution with the carrier and closed and labelled in a second revolution. In this way, the containers can circulate exactly twice with the aforesaid carrier. However, for the three treatments, namely the filling and closing and labelling, are carried out in three revolutions with the carrier.

In a further advantageous embodiment, the filling units and the closing units are arranged to be offset from one another on the carrier. In this way, it is possible for a plurality of treatment units to be arranged as a whole on the carrier, in which case the filling units and the closing units, and optionally also the labelling units, are arranged to be one behind the other on the carrier. This sequence can also, however, be arranged in a different manner. In this way, it would be possible for the same number of filling units, closing units, and labelling units to be arranged as a whole on the carrier in each case and for them to be arranged in a pre-set sequence one behind the other on the carrier in each case. In some embodiments, individual treatment units can include a combination of filling and closing units.

Treatment units of this type can be interchanged. Preferably, labelling units can be interchanged. The containers can be provisioned with labels in a different manner.

In other embodiments, the labelling units are arranged so as to be stationary at least in part with respect to the carrier and, in particular, radially outside the external periphery of the carrier. In this case, it is also possible for these labelling units to be subdivided in turn into different groups, so that, depending upon the requirements of the customers, various labels can also be applied to the containers. In other words, it is advantageous for the labelling units to be interchangeable.

In the case of a further advantageous embodiment, containers treated in different ways are capable of being supplied to the carrier. In this way, it is possible for totally non-treated containers, i.e., containers which are empty and not labelled, first to be supplied to the carrier and for containers which are already filled or closed or labelled respectively to be supplied in a subsequent revolution.

In another embodiment, the apparatus has a supply device which supplies the containers to the carrier as well as a first and a second supply unit which supply the containers to this supply device in each case. The supply unit can be a supply star wheel or the like, which supplies the containers to the carrier. The supply star wheel can be supplied for example by another star wheel with empty and non-labelled containers and at the same time by another star wheel with containers already treated in a pre-set manner, for example, filled containers.

The supply device advantageously has a plurality of controllable holding elements or gripping elements respectively for the holding or gripping respectively of the containers. In this manner, each individual gripping element can be controlled individually. For example, a gripping element can be opened and closed in order to accept a container. In this way, it is possible for the containers to be transferred in a pre-set manner, and preferably also in sequence, to the supply device and from there to the carrier device. Accordingly, the containers are preferably conveyed from the supply device already at different treatment stages.

In another embodiment, the apparatus has at least one distribution changing device which changes a distribution between the individual containers during the conveying thereof. In this manner, it is possible for an infeed worm wheel, which brings the containers to the distribution of the carrier, to be provided already upstream of the supply device or the run-in star wheel respectively. In addition, the additional supply unit mentioned above can also be designed, for example, in the form of a distribution delay star wheel which changes a distribution between the individual containers in order to adapt the distribution of the containers in this way to a further treatment step such as a closing step. In this manner, the apparatus advantageously has two or more distribution changing devices of this type. The distribution changing devices mentioned herein can include for example infeed worm wheels or distribution delay star wheels.

In this manner, it is also advantageous for a distribution changing device to be provided which conveys containers already treated in a pre-set manner, i.e., already conveyed by the conveying device, back to the carrier.

Embodiments of the present inventive concepts further relate to a method of treating containers with a plurality of treatment units, in which the containers are conveyed during the treatment thereof at least in part by means of a carrier. Also, the containers are filled with a flowable medium by filling units which are a first group of these treatment units and have filling elements which are arranged in each case on the carrier and which move jointly with the containers at least sectionwise. After the filling with the flowable medium, the containers are closed with a closure by closing units which include a second group of these treatment units and have closing elements which are arranged in each case on a carrier and which move jointly with the containers at least sectionwise. In addition, labels are applied to the containers by labelling units which are a third group of these treatment units.

According to embodiments of the inventive concepts, the filling of the containers is carried out by the filling units, the labelling of the containers is carried out by the labelling units, and the closing of the containers is carried out by the closing units during a conveying of the containers by a movable carrier.

In some embodiments, the method includes subjecting containers during the conveying with the aforesaid carrier to the at least three aforesaid treatment steps, namely filling, closing and labelling. In addition, still further treatment steps can be carried out, such as for example a sterilization of the containers or even leakage tests and the like.

It is advantageous for the containers to be conveyed during the processing or treatment thereof by the treatment units at least twice by the carrier. In this manner, the carrier advantageously conveys containers at the same time at least for a time in different treatment stages, for example, non-treated containers, in order to fill them, and at the same time already filled containers, in order to close them, or even already filled and closed containers, in order to label them and the like.

In accordance with another method, a distribution between the containers is changed at least once during the treatment. In this manner, it is possible for the distribution of the containers to be changed after the filling thereof, in order to adapt the distribution to the distribution of individual closing units.

FIG. 1 is an illustration of an apparatus 1 for processing containers, in accordance with an embodiment of the inventive concepts. The apparatus 1 includes a carrier 2 which also serves as a conveying device for the container and on which are arranged a plurality of treatment units 4, 6, 8. The treatment units 4 are filling devices which fill the containers with a liquid. The treatment units 8 are closing stations which provide the containers with closures. For example, the treatment units 8 screw closures or related sealing devices onto the containers. The treatment units 6 are labelling units which provide the containers with labels. Closing elements 18, such as closing heads, screw the closures onto the containers. Filling elements 14 can fill the containers in each case.

The carrier 2 or the conveying device, respectively, is arranged to be rotatable about an axis of rotation D. The individual treatment units 8 can be arranged equidistantly in the peripheral direction of the carrier in this case. The reference P2 designates the conveying direction of the containers during the conveying thereof on the carrier 2 or during the conveying thereof with the treatment units 4, 6, 8 arranged on the carrier, respectively.

The containers 10 are shown differently, depending upon the treatment state thereof. For example, the containers 10 represented by empty circles designate containers which are not yet treated and which are neither filled nor closed, nor labelled. The black containers 10 refer to containers which are filled and closed. The circles provided with a building block pattern designate containers 10 which are filled but not yet closed or labelled.

In this manner, in some embodiments as shown in FIG. 1, the containers are filled in a first passage, are closed in a second revolution, and provided with labels in a third revolution with the carrier 2 or the conveying device, respectively. As mentioned above, however, the sequence can also be arranged differently, so that first of all a first revolution takes place in which the containers are filled, after that a second revolution in which they are labelled, and finally a third revolution in which they are closed. In addition, it is possible for the containers first to be labelled, then filled and then closed. In this way, any desired sequences are provided in principle, in which case, however, the containers are filled first and closed only after being filled.

The supply device 20, also referred to as a run-in star wheel, includes a plurality of controllable gripping elements 22 which grip the containers 10 for the purpose of conveying the latter along the arrow P1. In some embodiments, the supply unit 32 supplies every third gripping element 22 with one or more containers 10. The supply unit 32 can be an infeed worm wheel which brings the containers to a pre-set distribution.

The pre-treated containers are then transferred back again to the run-in star wheel 20 by way of a run-out star wheel 36 and a transfer star wheel 34. In this way, it is possible for example for containers which have been filled, but not yet closed or labelled, to be conveyed to the run-in star wheel 20 by way of the transfer star wheel 34. This transfer star wheel 34 can include a distribution delay star wheel by which the distribution between the individual containers can be changed.

The empty gripping elements 22 can be provided with containers, so that as a whole the containers are conveyed on the run-in star wheel 20 in a plurality of different treatment stages, and can be transferred accordingly to the carrier 2. In addition, the transfer star wheel 34 can include at least one gripping element 44, which serves to hold and convey the containers. In this way, the containers can be guided, and preferably separated, through the entire apparatus. Furthermore, in a possible embodiment the transfer star wheel 34 has a plurality of arms 46 which are pivotable with respect to a carrier 45 and on which are arranged the individual gripping elements 44.

A removal device 38 removes the ready treated containers, i.e., the containers which are filled, closed, and labelled. In some embodiments, for example, shown in FIG. 1 the treatment stations 4, 6, 8 are arranged in an alternating manner in each case on the carrier 2. In some embodiments, the labelling units 6 are arranged not on the carrier 2 itself but in the vicinity thereof, in order to provide the individual containers with labels. The individual treatment stations 4, 6, 8 are illustrated only roughly diagrammatically in each case. Some individual treatment units, for example the filling units 4, can be offset with respect to other treatment units in the radial direction of the carrier.

It is therefore advantageous for the containers to remain on a specified treatment station 4, 6, 8 during a specified revolution on the carrier.

Figure 2:
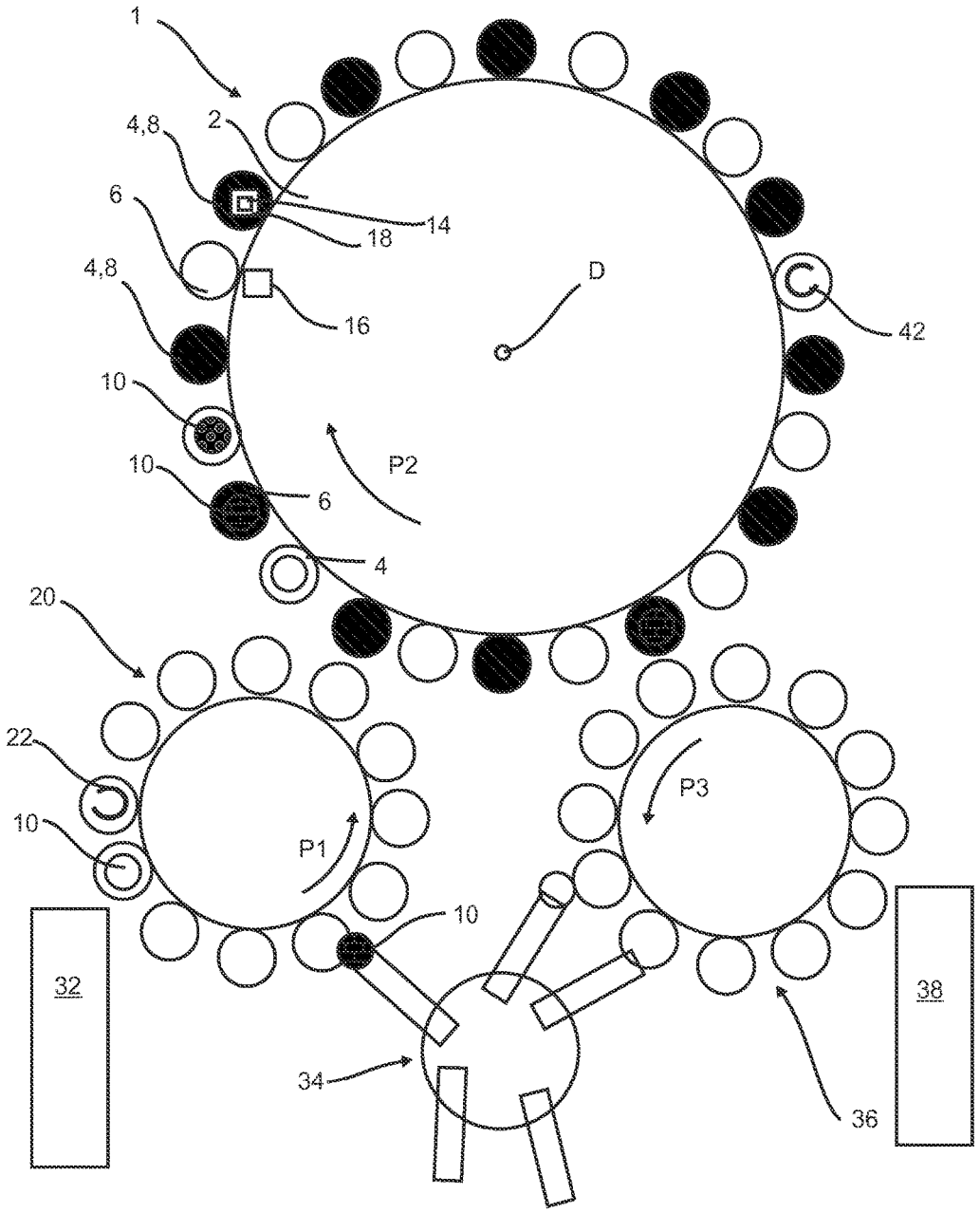
FIG. 2 is an illustration of an apparatus in accordance with another embodiment of the inventive concepts.

FIG. 2 is an illustration of an apparatus 1 in accordance with another embodiment of the inventive concepts. The apparatus 1 can be the same or similar to the apparatus 1 of FIG. 1

The filling units 4 and the closing units 8 are combined in each case to form a common treatment station 4, 8, so that in this case two types of treatment stations are arranged in an alternating manner on the carrier 2. The containers are therefore conveyed only twice by the carrier 2 along the conveying path P. In the embodiment shown in FIG. 1, on the other hand, the containers are conveyed three times along the conveying path P2. The arrows P1 to P4 indicate as a whole the conveying path of the containers. The carrier 2 can include gripping elements 42.

The individual containers can be subjected to all three treatment steps during a passage, passage on the carrier 2 entails each individual treatment unit being provided in combination as a labelling station, as a filling device, and as a closing device.

Figure 3A:
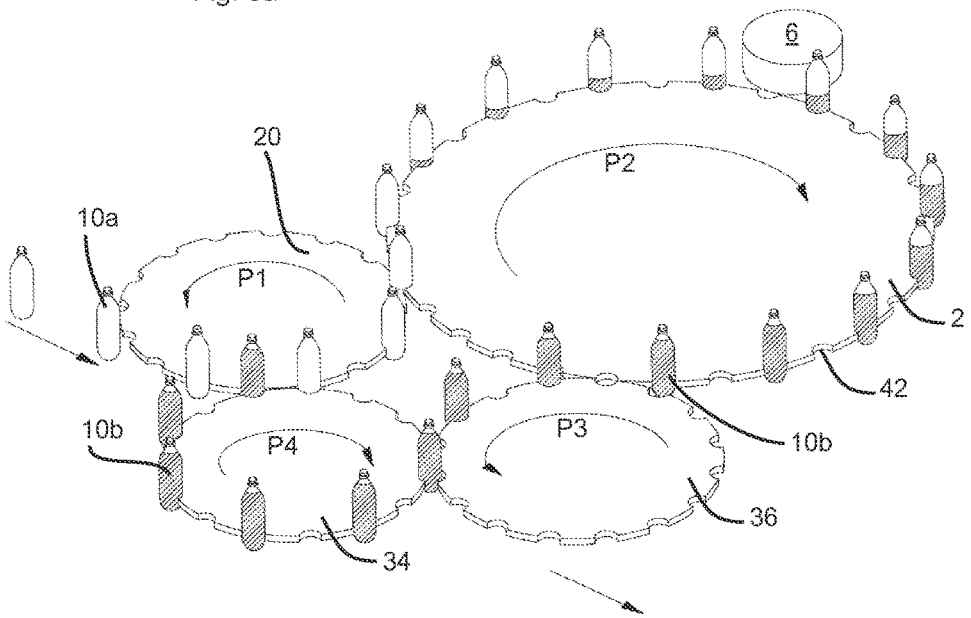
FIGS. 3*a, b* are two illustrations of a method according to the inventive concepts.
Figure 3B:
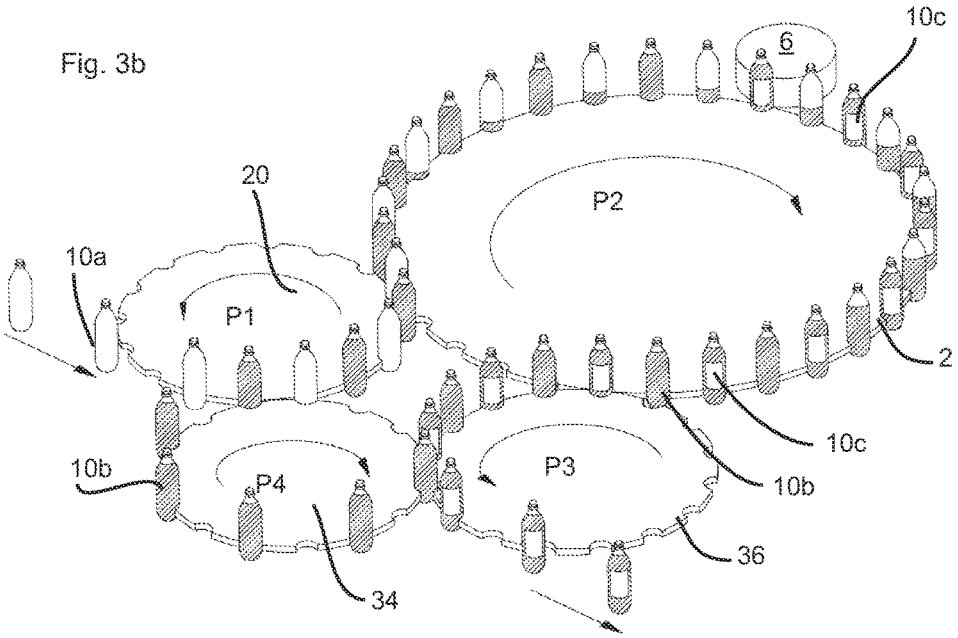

FIGS. 3*a* and 3*b* show two further illustrations to demonstrate a method according to the inventive concepts. The filling units and the closing units are not shown in this case. In FIG. 3*a*, empty containers 10*a* are supplied to a conveying device 2, for example, from a star wheel 20. The containers 10*a* are filled during the transfer to conveying device 2. The filled containers are then provided with closures during this passage on the conveying device 2. The filled and closed containers are then conveyed back to the run-in star wheel 20 by way of the run-out star wheel 36 and the transfer star wheel 34, shown by arrow P4. The transfer star wheel 34 is not a distribution delay star wheel in this case.

On the run-in star wheel 20, every other second gripping element is provided with empty containers 10*a*. The respective free gripping elements remaining are then provided with the filled and closed containers 10*b*, i.e., each filled and closed container 10*b* between adjacent empty containers 10*a*.

The containers 10*b* are, as shown in FIG. 3*b*, transferred to the conveying device 2 again and are labelled by the labelling unit 6 during their second revolution about the conveying device 2. The filled closed, and labelled containers 10*c* are removed by the run-out star wheel 36.

Figure 4:
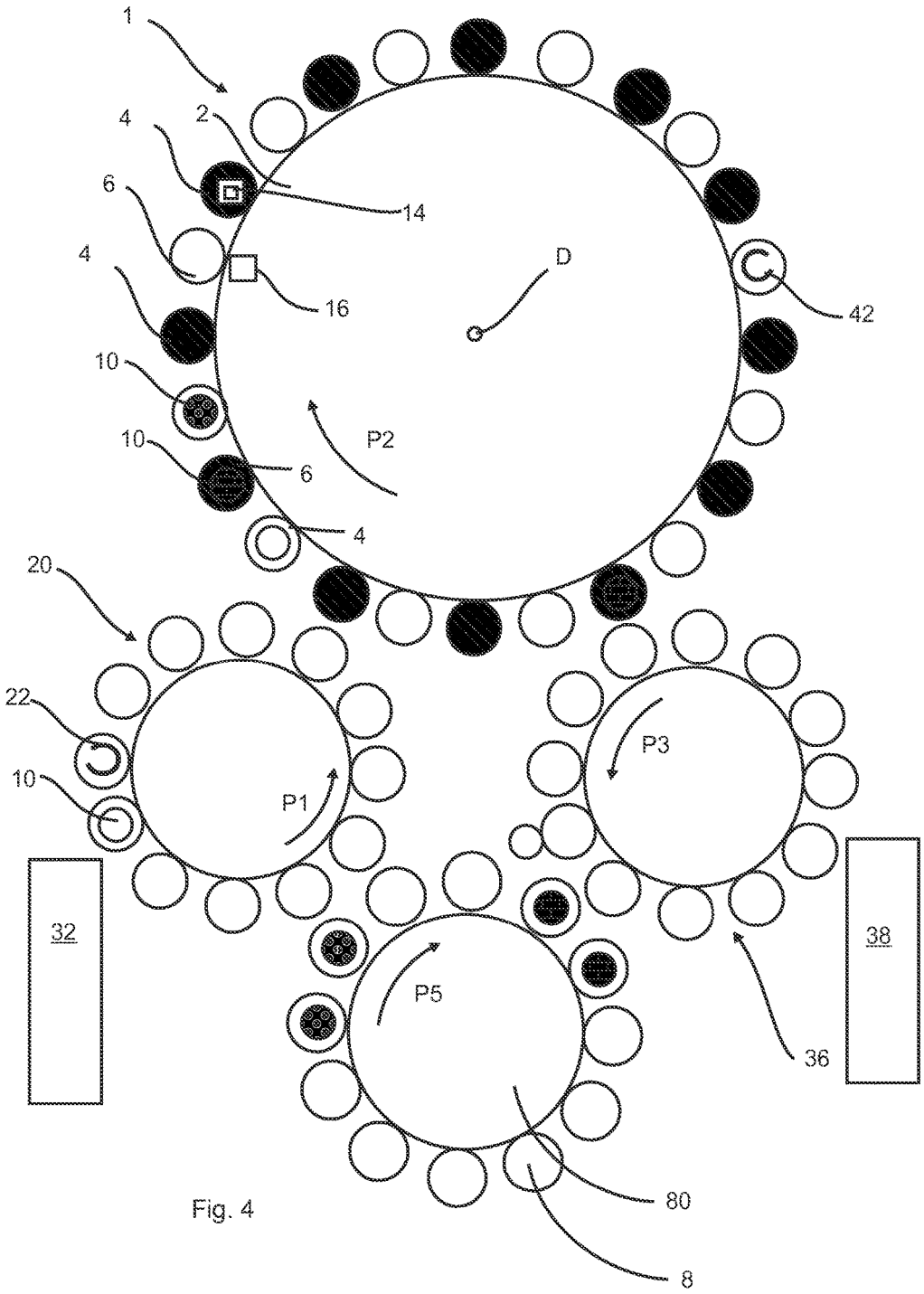
FIG. 4 is an illustration of a treatment apparatus for containers, in accordance with some embodiments.

FIG. 4 shows a further embodiment of an apparatus according to the inventive concepts. In the case of this embodiment the closing units are not on the carrier 2 but on a closing unit 80. The closure unit 80 can receive filled containers from the run-out star wheel 36 and close the containers with closures in the course of the conveying with the closure unit 80. The closed containers are then transferred to the carrier 2 again by way of the run-in star wheel or supply device respectively and are then labelled by the labelling units 6.

In addition, with this design both the filling of the containers and the labelling of the containers are carried out with the same unit and only the closing is carried out with the closing unit 80 which is coupled to the filling and labelling unit by way of the run-out 36 and run-in star wheels 20. In this embodiment too, the run-in star wheel 20 serves both to convey the still empty and not labelled containers and to convey the already filled and closed containers. The run-out star wheel 36 preferably both conveys the containers which are only filled but not yet closed and not labelled, and conveys the containers which are filled, labelled and closed. As mentioned, it is possible in this case for the run-in star wheel or supply device 20 respectively and/or the run-out star wheel 36 to be designed in the form of distribution delay star wheels or, on the other hand, also in the form of so-called multiple-function star wheels. In addition, a relatively small distribution between the individual containers 10 on the apparatus 1 is made possible by the foregoing.

While the present inventive concepts have been particularly shown and described above with reference to exemplary embodiments thereof, it will be understood by those of ordinary skill in the art, that various changes in form and detail can be made without departing from the spirit and scope of the present inventive concepts.

The invention claimed is:

1. An apparatus for processing containers, comprising:

a movable carrier for conveying the containers;

a plurality of filling units constructed and arranged to fill the containers with a flowable medium during the conveying of the containers;

a plurality of labelling devices constructed and arranged to apply labels to the containers during the conveying of the containers; and a plurality of closing units, the closing units constructed and arranged to close the containers filled with the flowable medium during the conveying of the containers, wherein the filling units, the labelling devices, and the closing units communicate with the carrier and the filling units and the closing units are combined at a common treatment station in such a way that each container is conveyed twice along a conveying path by the carrier in order to be filled, labelled and closed so that the containers are filled and closed exclusively in a first revolution on or by the carrier and are labelled exclusively in a second revolution on or by the carrier.

2. An apparatus according to claim 1, wherein the carrier is rotatable about a pre-set axis of rotation.

3. An apparatus according to claim 1, wherein the labelling units are stationary with respect to the movable carrier.

4. An apparatus according to claim 1, wherein the labelling units are interchangeable.

5. An apparatus according to claim 1, wherein containers in different treatment stages are supplied to the carrier.

6. An apparatus according to claim 1, further comprising a supply device that supplies the containers to the carrier.

7. An apparatus according to claim 6, further comprising a first supply unit and a second supply unit that supply containers to the supply device.

8. An apparatus according to claim 1, further comprising at least one distribution changing device which changes a distribution between the containers.

9. An apparatus according to claim 1, wherein the filling units comprise filling elements which are constructed and arranged on the carrier and which move jointly with the containers at least sectionwise.

10. An apparatus according to claim 1, wherein the closing units comprise closure elements which are constructed and arranged on the carrier, and which move jointly with the containers at least sectionwise.

11. An apparatus according to claim 1, wherein each filling unit, labelling device, and closing unit is coupled to the movable carrier.

12. An apparatus according to claim 1, wherein at least one of the filling units, the labelling devices, and the closing units is separate from the movable carrier and the remainder of the filling units, the labelling devices, and the closing units is coupled to the movable carrier.

* * * * *